US012196065B2

(12) United States Patent
Lozano et al.

(10) Patent No.: US 12,196,065 B2
(45) Date of Patent: Jan. 14, 2025

(54) DOWNHOLE GAS VENTILATION SYSTEM FOR ARTIFICIAL LIFT APPLICATIONS

(71) Applicant: Diamondback E&P LLC, Midland, TX (US)

(72) Inventors: Martin Lozano, Midland, TX (US); Nathan Luoma, Midland, TX (US); Cody Casey, Midland, TX (US); Jeffrey Knight, Midland, TX (US)

(73) Assignee: Diamondback E&P LLC, Midland, TX (US)

( * ) Notice: Subject to any disclaimer, the term of this patent is extended or adjusted under 35 U.S.C. 154(b) by 0 days.

(21) Appl. No.: 18/101,643

(22) Filed: Jan. 26, 2023

(65) Prior Publication Data

US 2024/0254866 A1 Aug. 1, 2024

(51) Int. Cl.

| | |
|---|---|
| ***E21B 43/12*** | (2006.01) |
| ***E21B 34/06*** | (2006.01) |
| ***E21B 43/38*** | (2006.01) |

(52) U.S. Cl.

CPC ..... *E21B 43/123* (2013.01); *E21B 34/06* (2013.01); *E21B 43/38* (2013.01); *E21B 43/122* (2013.01)

(58) Field of Classification Search

CPC ..... E21B 43/38; E21B 43/35; E21B 43/123; E21B 43/122; E21B 34/06

See application file for complete search history.

(56) References Cited

U.S. PATENT DOCUMENTS

| | | | | | |
|---|---|---|---|---|---|
| 1,628,900 | A * | 5/1927 | Neilsen | E21B 43/38 | 96/214 |
| 2,748,719 | A * | 6/1956 | Wells | E21B 43/38 | 166/105.5 |
| 5,588,486 | A * | 12/1996 | Heinrichs | E21B 43/38 | 166/50 |
| 6,032,737 | A * | 3/2000 | Brady | E21B 43/385 | 166/266 |

(Continued)

OTHER PUBLICATIONS

Yonghui et al., "An Approach to Apply the Gas in the Annulus to Assist Pumping Oil in High-GOR Wells," Paper presented at the Production and Operations Symposium, Oklahoma City, Oklahoma, U.S.A., Mar. 2007 (Abstract).

*Primary Examiner* — George S Gray

(74) *Attorney, Agent, or Firm* — Fish & Richardson P.C.

(57) ABSTRACT

A downhole gas ventilation system includes a perforated tubing positioned within a production tubing installed in a wellbore. The perforated tubing couples to wellbore equipment positioned uphole of the perforated tubing within the wellbore to flow multiphase hydrocarbons received within the perforated tubing into the wellbore equipment. The perforated tubing includes two ends and a sidewall connecting the two. Multiple perforations formed in the sidewall receives the multiphase hydrocarbons within the perforated tubing. The perforated tubing outer diameter is smaller than the production tubing inner diameter. The perforated tubing facilitates separation of the liquid phase from the gaseous phase. A one-way check valve is coupled to the upper end of the perforated tubing to vent the gaseous phase that rises towards the upper end out of the perforated tubing, out of the production tubing and into an annulus defined between the production tubing and the wellbore inner wall.

15 Claims, 8 Drawing Sheets

(56) References Cited

U.S. PATENT DOCUMENTS

| | | | | |
|---|---|---|---|---|
| 6,035,934 | A * | 3/2000 | Stevenson | E21B 43/385 166/265 |
| 6,367,547 | B1 * | 4/2002 | Towers | E21B 43/385 405/59 |
| 6,382,317 | B1 * | 5/2002 | Cobb | E21B 43/35 96/216 |
| 7,789,158 | B2 | 9/2010 | Zupanick | |
| 2009/0272538 | A1 * | 11/2009 | Kennedy | E21B 43/38 166/105.5 |
| 2016/0130922 | A1 * | 5/2016 | Wilson | E21B 43/128 166/105 |
| 2017/0044888 | A1 * | 2/2017 | Bommer | E21B 43/12 |

* cited by examiner

DOWNHOLE GAS VENTILATION SYSTEM FOR ARTIFICIAL LIFT APPLICATIONS

TECHNICAL FIELD

This disclosure relates to wellbore operations, for example, producing hydrocarbons through wellbores.

BACKGROUND

Hydrocarbons entrapped in subsurface reservoirs are raised to the surface, i.e., produced, through wellbores formed from the surface to the subsurface reservoirs through a subterranean zone (e.g., a formation, a portion of a formation, multiple formations). The hydrocarbons (e.g., petroleum, natural gas, water, combinations of them) are multiphase fluids including a liquid phase and a gaseous phase. In a first stage of hydrocarbon recovery, the multiphase fluid flows through the wellbore under reservoir pressure. Over time, reservoir pressure decreases. Then, secondary (and sometimes tertiary) stages of hydrocarbon recovery are implemented in which the multiphase fluids are produced using artificial lift techniques. In one such technique, a pump is disposed at a downhole location. The pump draws the multiphase hydrocarbons that is downhole of the pump and flows the hydrocarbons towards the surface. The presence of gaseous phase in the flowing hydrocarbons can result in inefficiency in pump operations.

SUMMARY

This disclosure describes technologies relating to downhole gas ventilation systems for artificial lift applications.

Certain aspects of the subject matter described here can be implemented as a downhole gas ventilation system. The system includes a perforated tubing configured to be positioned within a production tubing installed in a wellbore formed in a subterranean zone to a subsurface reservoir in which multiphase hydrocarbons including a liquid phase and a gaseous phase are entrapped. The perforated tubing can fluidically couple to wellbore equipment configured to be positioned uphole of the perforated tubing within the wellbore and to permit flow of the multiphase hydrocarbons received within the perforated tubing into the wellbore equipment. The perforated tubing includes an upper end, a lower end and a sidewall connecting the upper end and the lower end. The perforated tubing includes multiple perforations formed in the sidewall and configured to receive the multiphase hydrocarbons within the perforated tubing. An outer diameter of the perforated tubing is smaller than an inner diameter of the production tubing. The perforated tubing can facilitate separation of the liquid phase from the gaseous phase of the received multiphase hydrocarbons. The system includes a one-way check valve fluidically coupled to the upper end of the perforated tubing. The check valve is configured to vent the gaseous phase that rises towards the upper end of the perforated tubing out of the perforated tubing, out of the production tubing and into an annulus defined between the production tubing and an inner wall of the wellbore.

An aspect combinable with any other aspect includes the following features. The wellbore equipment includes a mandrel configured to receive the multiphase hydrocarbons from which a portion of the gaseous phase has been separated through the upper end of the perforated tubing.

An aspect combinable with any other aspect includes the following features. The system includes a seating nipple that can connect to the perforated tubing. The seating nipple, on one end, can attach to the upper end of the perforated tubing, and on the opposite end, can attach to the mandrel. The seating nipple can flow the liquid phase that is separated from gaseous phase within the perforated tubing into the mandrel.

An aspect combinable with any other aspect includes the following features. The upper end of the perforated tubing is directly connected to the mandrel.

An aspect combinable with any other aspect includes the following features. The mandrel is a gas lift mandrel that includes a gas lift valve fluidically coupled to the production tubing. The one-way check valve is installed within the gas lift mandrel.

An aspect combinable with any other aspect includes the following features. At least a portion of the perforated tubing including the upper end passes through the gas lift mandrel.

An aspect combinable with any other aspect includes the following features. An outer diameter of the gas lift mandrel is greater than an outer diameter of the production tubing and smaller than an inner diameter of the wellbore.

An aspect combinable with any other aspect includes the following features. The one-way check valve is installed in a portion of the gas lift mandrel that extends into the annulus.

An aspect combinable with any other aspect includes the following features. The perforated tubing is substantially concentric with respect to the production tubing.

An aspect combinable with any other aspect includes the following features. The perforated tubing is installed adjacent an inner surface of the production tubing.

An aspect combinable with any other aspect includes the following features. The perforated tubing is an elongate, cylindrical tubing.

An aspect combinable with any other aspect includes the following features. The perforated tubing is an elongate, helical tubing.

An aspect combinable with any other aspect includes the following features. The perforated tubing includes alternating portions of larger and smaller volumes arranged along an axis of the perforated tubing.

An aspect combinable with any other aspect includes the following features. The perforated tubing is a gas anchor or a dip tube.

Certain aspects of the subject matter described here can be implemented as a method performed in a wellbore formed in a subterranean zone to a subsurface reservoir in which multiphase hydrocarbons including a liquid phase and a gaseous phase are entrapped. The multiphase hydrocarbons flow from the subsurface reservoir through the wellbore. A separator is positioned at a downhole location in the wellbore. A portion of the gaseous phase is separated from the liquid phase before flowing into the separator through the intake resulting in multiphase hydrocarbons with reduced gaseous phase. A production tubing is fluidically coupled to the separator. The production tubing extends to the surface and can flow the multiphase hydrocarbons with reduced gaseous phase received via the intake to the surface. A gas ventilation system including a one-way check valve is fluidically coupled to the production tubing. The gas ventilation system can receive the multiphase hydrocarbons with reduced gaseous phase, further separate gaseous phase in the multiphase hydrocarbons with the reduced gaseous phase, and flow gaseous phase in the multiphase hydrocarbons with reduced gaseous phase received through the intake into an annulus defined between the production tubing and an inner wall of the wellbore.

An aspect combinable with any other aspect includes the following features. The wellbore includes a substantially vertical portion and a deviated portion extending from a downhole end of the substantially vertical portion through the subterranean zone. The wellbore includes a bend connecting the substantially vertical portion to the deviated portion. When positioning the separator at the downhole location, the separator is positioned in the bend.

Certain aspects of the subject matter described here can be implemented as a method performed in a wellbore formed in a subterranean zone to a subsurface reservoir in which multiphase hydrocarbons including a liquid phase and a gaseous phase are entrapped. The multiphase hydrocarbons flow from the subsurface reservoir through the wellbore. The multiphase hydrocarbons are flowed into a gas separator positioned at a downhole location in the wellbore. The gas separator separates a portion of the gaseous phase from the liquid phase in multiphase hydrocarbons with reduced gaseous phase. The multiphase hydrocarbons with the reduced gaseous phase are flowed through a production tubing fluidically coupled to the gas separator and extending to the surface. The production tubing defines an annulus with an inner wall of the wellbore. In a perforated tubing installed downstream of the gas separator and fluidically coupled to the production tubing, the portion of the multiphase hydrocarbons with the reduced gaseous phase are received. The perforated tubing further separates gaseous phase from the portion of the multiphase hydrocarbons with the reduced gaseous phase. The one-way check valve flows the gaseous phase separated by the perforated tubing.

An aspect combinable with any other aspect includes the following features. The wellbore includes a substantially vertical portion and a deviated portion extending from a downhole end of the substantially vertical portion through the subterranean zone. The wellbore includes a bend connecting the substantially vertical portion to the deviated portion. When positioning the separator at the downhole location, the separator is positioned in the bend.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

This disclosure describes a downhole gas ventilation system (DGVS) that includes a mandrel (or piping or tubing) coupled with a dip tube, gas anchor or smaller tubing with openings for liquids to enter and a one-way check valve. When the DGVS is positioned in the flow path of a multiphase hydrocarbon stream, the DGVS creates fluid isolation between upstream and downstream fluid, which enables separation between the liquid and gaseous phases. As described below, the gaseous phase is removed via the check valve allowing higher liquid phase to flow towards the surface or towards an inlet of a downhole pump installed in a wellbore to flow the hydrocarbons through the wellbore towards the surface.

Figure 1:
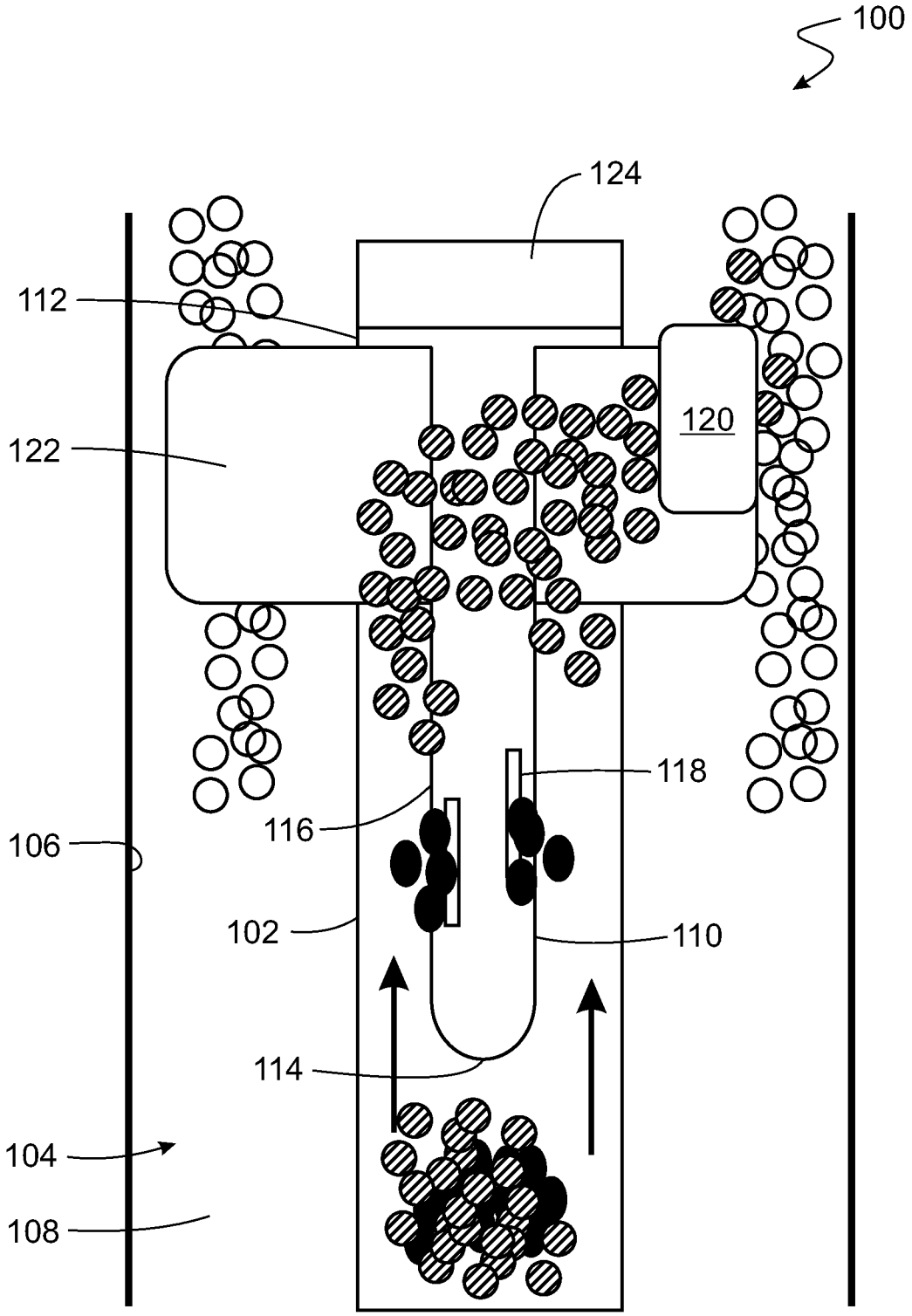
FIG. 1 is a schematic diagram of a downhole gas ventilation system.

FIG. 1 is a schematic diagram of a downhole gas ventilation system (DGVS) 100. Specifically, FIG. 1 shows an implementation of the DGVS 100 installed in a production tubing 102, which, in turn, is installed within a wellbore 104 formed from a surface (not shown) to a subsurface reservoir (not shown). The wellbore 104 can be uncased or cased with a casing 106 installed within the wellbore 104. The casing 106 and the production tubing 102 define an annulus 108.

In some implementations, the DGVS 100 includes a perforated tubing 110 that is positioned within the production tubing 102. For example, the perforated tubing 110 can be a dip tube or a gas anchor. An outer diameter of the perforated tubing 110 is smaller than that of the production tubing 102 so that the perforated tubing 110 can fit entirely within the production tubing 102. The perforated tubing 110 has an upper end 112, a lower end 114 and a sidewall 116 connecting the upper end 112 and the lower end 114. Multiple perforations (e.g., the perforation 118) are formed on the sidewall 116 of the perforated tubing 110. Each perforation is a hole, a slit, a radial slot, a radial port (or any combination of them or similar perforations) that extends through the sidewall 116. Each perforation is large enough to permit the multiphase hydrocarbons to enter into an inner volume of the perforated tubing 110 through the multiple perforations.

An outer diameter of the upper end 112 is at least equal to an inner diameter of the production tubing 102. Consequently, when the perforated tubing 110 is installed within the production tubing 102, the upper end 112 seals against the inner diameter of the production tubing 102. Any fluid that flows into an annular space between the production tubing 102 and the perforated tubing 110 cannot flow around or flow past the upper end 112, and is forced to enter the inner volume of the perforated tubing 110 through the multiple perforations. The uphole end 112 is fluidically coupled to wellbore equipment uphole of (i.e., downstream of) the upper end 112 such that fluid that flows into the inner volume of the perforated tubing 110 flows downstream into the wellbore equipment.

A one-way check valve 120 is fluidically coupled to the upper end 112 of the perforated tubing 110. Alternatives or additions to the one-way check valve 120 include a relief valve, a back pressure valve, or any orifice or opening that permits gas to pass from within the perforated tubing 110 to outside the perforated tubing 110. In some implementations, the check valve 112 is attached directly to the upper end 112 or to the sidewall 116 near the upper end 112 of the perforated tubing 110.

In some implementations, the perforated tubing 110 and the check valve 112 are each mounted to wellbore equipment 122, which is then connected to the production tubing 102. For example, as shown in the schematic in FIG. 1, the wellbore equipment 112 includes a mandrel 122 (e.g., a tubing) that is separate from and removably connected to the production tubing 102. In particular, the mandrel 122 can be a gas lift mandrel that includes a gas lift valve fluidically coupled to the production tubing 102. In such implementations, the perforated tubing 110 can be mechanically coupled to the wellbore equipment 112, for example, by direct welding, using threads or otherwise. The coupling is such that multiphase hydrocarbons can flow both from the production tubing 102 and from the perforated tubing 110 through the wellbore equipment 122 towards the surface of the wellbore 104. The check valve 120 can be installed on an inner side wall of the wellbore equipment 122. In such installations, one end of the check valve 120 resides within the wellbore equipment 122 and the other end opens to the annulus 108. An outer diameter of the wellbore equipment 122 can be the same as or greater than an outer diameter of the production tubing 102. In implementations in which the outer diameter of the wellbore equipment 122 is greater than that of the production tubing 102 and less than that of the wellbore 104, the check valve 120 can be installed on a portion of the wellbore equipment 122 that radially extends into the annulus 108. In implementations with the wellbore equipment 122, the wellbore equipment 122 can seal to the inner diameter of the production tubing 102 to prevent downstream flow of the multiphase hydrocarbons through the annular space between the production tubing 102 and the perforated tubing 110, thereby forcing the multiphase hydrocarbons to flow into the inner volume defined by the perforated tubing 110.

In some implementations, the DGVS 100 includes a seating nipple 124 to which the perforated tubing 110 can be connected, for example, by direct welding, using threads or otherwise. Alternatively, the seating nipple 124 can be screwed on top of the mandrel 122, e.g., the gas lift mandrel with the check valve 120. The seating nipple 124 can be any wellbore coupling equipment (e.g., a piece of tubing) that can facilitate a coupling between the perforated tubing 110 and equipment uphole of the perforated tubing 110, for example, additional tubing that extends to the surface or connects to an intake of a pump (not shown). On one end, the seating nipple 124 attaches to the upper end 112 of the perforated tubing 110. On the opposite end, the seating nipple 124 can attach to the wellbore equipment 122, for example, the mandrel. The seating nipple 124 resides uphole of the perforated tubing 110.

In an example operation, the DGVS 100 is mounted to the production tubing 102, which is installed within the wellbore 104. A downhole end of the production tubing 102 extends to the subsurface reservoir in which the multiphase hydrocarbons are entrapped. The liquid phase (schematically shown in FIG. 1 by solid black circles) and gaseous phases (schematically shown in FIG. 1 by black circles with cross hatches) of the multiphase hydrocarbons flow into the production tubing 102 at the downhole end and flow through the production tubing 102 towards the surface. Downstream from (i.e., uphole of) the downhole end of the production tubing 102, the multiphase hydrocarbons flow towards the perforated tubing 110 and, through the multiple perforations 118, into an inner volume of the perforated tubing 110. The upper end 112 of the perforated tubing 102 forms a seal that prevents downstream flow of the multiphase hydrocarbons in the annular space defined by the production tubing 102 and the perforated tubing 110. In implementations with the wellbore equipment 122 (e.g., the mandrel), the wellbore equipment 122 forms the seal. Consequently, the multiphase hydrocarbons is forced to flow into the inner volume of the perforated tubing 110.

The positioning of the perforated tubing 110 in the flow pathway of the multiphase hydrocarbons causes an isolation between upstream and downstream fluid. The isolation improves separation of the liquid phase from the gaseous phase, for example, due to gravimetric separation. The separated gaseous phase (schematically shown in FIG. 1 by hollow black circles) flows past the perforated tubing 110 towards the check valve 120 into the annulus 108. The multiphase fluid that flows past the perforated tubing 110 and towards the check valve 120 has a higher gaseous fraction compared to the multiphase fluid upstream of the perforated tubing 110. The multiphase fluid with higher liquid fraction flows into the perforated tubing 110 through the perforations 118 and into the production tubing 102 that is fluidically coupled to the perforated tubing 110.

Due to the separation of the gaseous phase from the liquid phase, the hydrocarbons that flow through the production tubing 102 (or other flow tubing) downstream of the perforated tubing 110 has a higher liquid fraction compared to the hydrocarbons upstream of the perforated tubing 110. In implementations in which a pump is installed downstream of the perforated tubing 110, the hydrocarbons with the higher liquid fraction will enter a pump intake and be pumped to the surface. By reducing a quantity of gaseous phase that enters the pump intake, pump efficiency can be improved.

Figure 2:
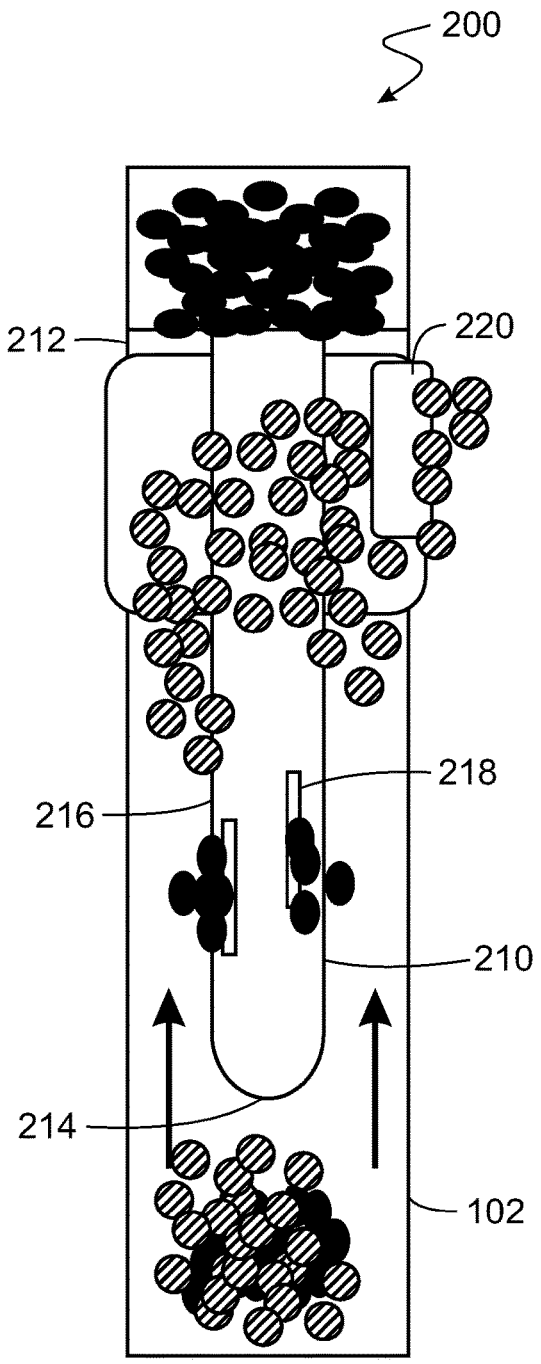
FIG. 2 is a schematic diagram of another implementation of the downhole gas ventilation system.

FIG. 2 is a schematic diagram of another implementation of the downhole gas ventilation system (DGVS) 200. The DGVS 200 can be fluidically coupled to the production tubing 102. The DGVS 200 includes substantially similar features as the DGVS 100, e.g., a perforated tubing 210, an upper end 212 of the perforated tubing 210, a lower end 214 of the perforated tubing 210, multiple perforations 218 on a sidewall 216 of the perforated tubing 210, and a check valve 220. The DGVS 200 is designed and constructed such that the perforated tubing 210 is substantially concentric with respect to the production tubing 102. In other words, the perforated tubing 210 is installed at a center of the production tubing 102. When installed, the perforated tubing 210 and the production tubing 102 define an annular space that surrounds all sides of the perforated tubing 210. In addition, the DGVS 200 excludes the seating nipple 124. Instead, the upper end 212 of the perforated tubing 210 attaches directly to a mandrel or other flow equipment (e.g., tubing) that is uphole of the DGVS 200. The check valve 220 is downhole of (i.e., upstream of) the upper end 212. The upper end 212 seals against the inner diameter of the production tubing 102, thereby forcing the multiphase hydrocarbons to enter the inner volume of the perforated tubing 210 through the multiple perforations 218 formed on the sidewall 216.

Figure 3:
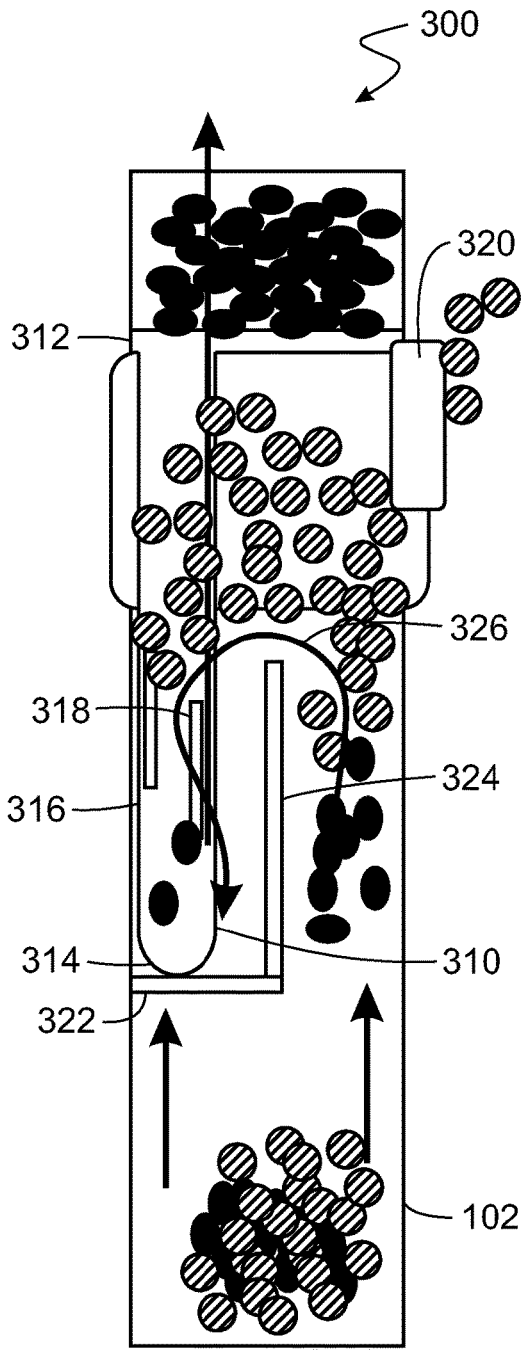
FIG. 3 is a schematic diagram of another implementation of the downhole gas ventilation system.

FIG. 3 is a schematic diagram of another implementation of the downhole gas ventilation system (DGVS) 300. The DGVS 300 can be fluidically coupled to the production tubing 102. The DGVS 300 includes substantially similar features as the DGVS 200, e.g., a perforated tubing 310, an upper end 312 of the perforated tubing 310, a lower end 314 of the perforated tubing 310, multiple perforations 318 on a sidewall 316 of the perforated tubing 310, and a check valve 320. The DGVS 300 is designed and constructed such that the perforated tubing 310 is substantially eccentric with respect to the production tubing 102. In other words, the perforated tubing 310 is installed away from a center of the production tubing 102, such as against an inner sidewall of the production tubing 102 or in a space in between the inner side wall and the center of the production tubing 102.

In such implementations, baffle plates are installed within the production tubing 102 adjacent the perforated tubing 310. For example, a horizontal plate 322 is installed uphole of the lower end 314 of the perforated tubing 314. An end of the horizontal plate 322 extends to the inner wall of the production tubing 102. The other end of the horizontal plate 322 extends away from the inner wall of the production tubing 102 past the lower end 314 of the perforated tubing 314. A vertical plate 324 is attached to the horizontal plate 324, specifically to the other end of the horizontal plate 322, with the other end of the vertical plate 324 being a free end. The baffle plates are sized such that the multiple perforations (or at least a portion of the perforations) are downhole of the free end of the vertical plate 324. Such an arrangement creates a flow path for the multiphase fluids in a downhole direction as shown by the arrow 324. The multiphase hydrocarbons flow past the baffle plates and into the multiple perforations 318 in the sidewall 316 of the perforated tubing 310. The check valve 320 is downhole of (i.e., upstream of) the upper end 312. The upper end 312 seals against the inner diameter of the production tubing 102, thereby forcing the multiphase hydrocarbons to enter the inner volume of the perforated tubing 310 through the multiple perforations 318 formed on the sidewall 316. In some implementations, the DGVS 300 can be implemented with the seated nipple 124 (FIG. 1).

Figure 4:
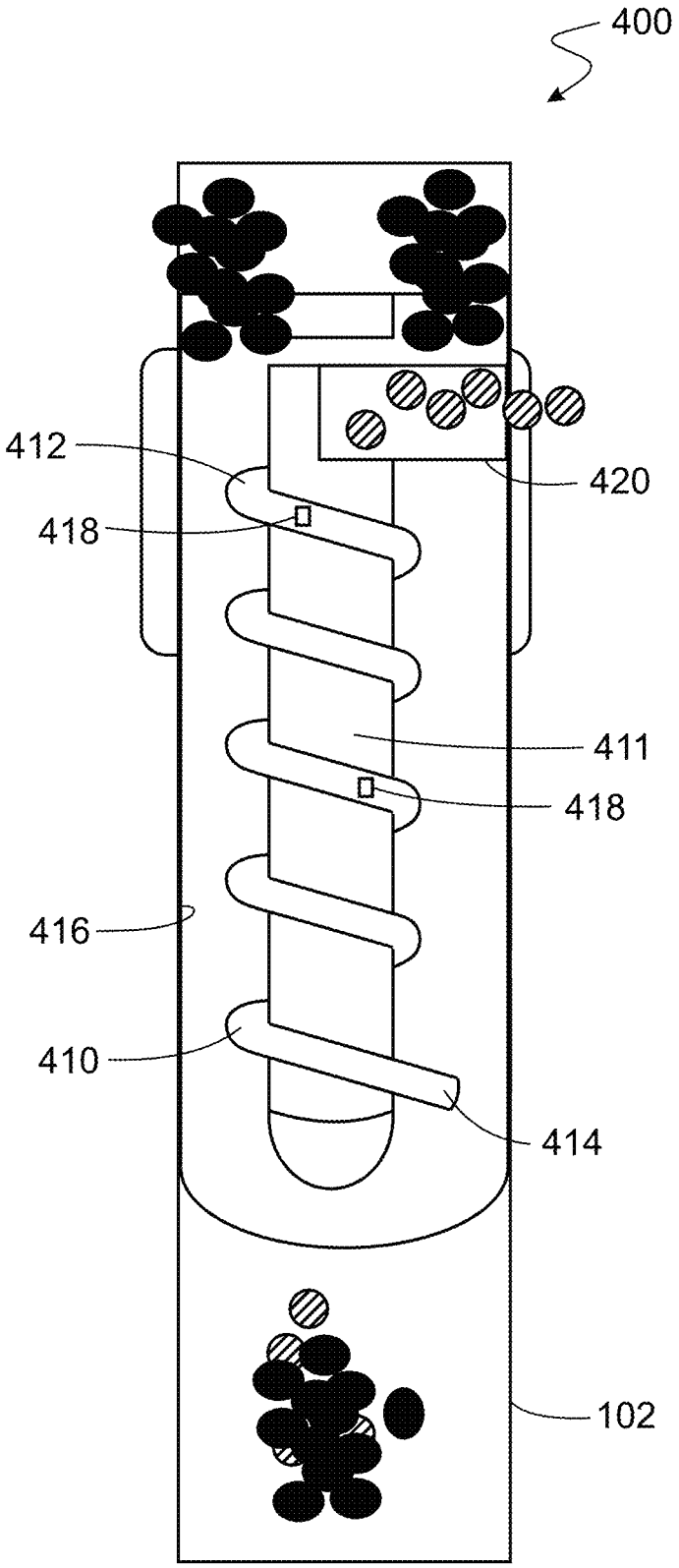
FIG. 4 is a schematic diagram of another implementation of the downhole gas ventilation system.

FIG. 4 is a schematic diagram of another implementation of the downhole gas ventilation system (DGVS) 400. The DGVS 400 can be fluidically coupled to the production tubing 102. The DGVS 400 includes a spiral tubing 410 coupled to a straight tubing 411. The spiral tubing 410 includes an upper end 412 and a lower end 414. When installed within the production tubing 102, the lower end 414 can be an inlet to receive the multiphase hydrocarbons including the liquid and gaseous phases. The multiphase hydrocarbons flow through the spiral pathway of the spiral tubing 410. The spiral pathway includes perforations 418 that facilitates separation of the gaseous and liquid phases. As the multiphase fluid flows through the spiral, the gaseous phase will have a tendency to be on the inner diameter of the spiral while the liquid (heavier) hydrocarbons will be on the outer portion of the spiral. The gaseous rich hydrocarbons will flow through perforations 418 while the liquid heavier will remain on the outer portion of the spiral to continue flowing upwards towards the upper end of the spiral tubing 412. A check valve 420 can be fluidically coupled to the inner diameter of 411 allowing the separated gaseous phase to vent through the check valve 420 unto the annulus (not shown in FIG. 4). In some implementations, a housing 416 can be installed within the production tubing 102, and the spiral tubing 410 and the straight tubing 411 can be installed within the housing 416. In addition to housing the tubings, the housing 416 seals against the inner diameter of the production tubing 102 forcing fluid to flow into the spiral tubing 410. In such implementations, the lower end 414 can reside downhole of (i.e., upstream of) the housing 416, and the upper end 412 can reside uphole of (i.e., downstream of) the housing 416.

Figure 5:
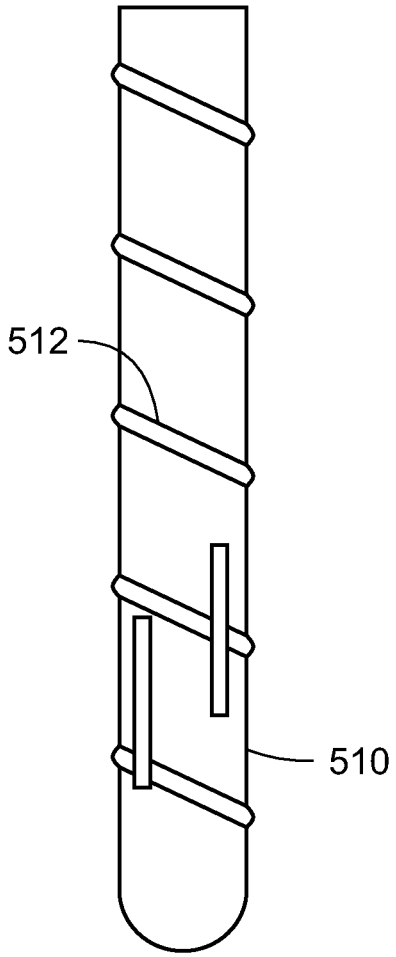
FIG. 5 is a schematic diagram of another implementation of a perforated tubing for use with a downhole gas ventilation system.

FIG. 5 is a schematic diagram of another implementation of a perforated tubing 510 for use with a downhole gas ventilation system (DGVS), for example, the DGVS 100, 200 or 300. Like the perforated tubing 110 (FIG. 1) of the DGVS 100 (FIG. 1), the perforated tubing 510 includes an elongate body with a cylindrical cross-section. In addition, the perforated tubing 512 defines spiral or helical grooves 512 around an outer surface of the perforated tubing 512. The grooves 512 facilitate greater separation of the gaseous phase before exiting the check valve (not shown). At least some of the perforations can be formed on the grooves 512.

Figure 6:
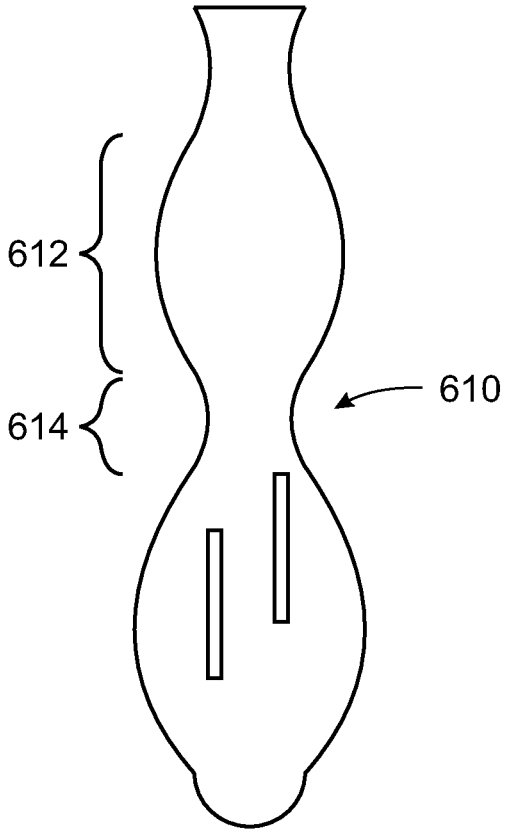
FIG. 6 is a schematic diagram of another implementation of a perforated tubing for use with a downhole gas ventilation system.

FIG. 6 is a schematic diagram of another implementation of a perforated tubing 600 for use with a downhole gas ventilation system (DGVS), for example, the DGVS 100, 200 or 300. The perforated tubing 610 includes regions of varying volume across an axial length of the perforated tubing 610. For example, the perforated tubing 610 includes alternating portions of larger volumes (e.g., a portion 612) and smaller volumes (e.g., a portion 614) arranged along an axis of the perforated tubing. The variation in volume across the length of the perforated tubing 610 creates extra pressure drop to allow more free gas to escape to the annulus via the check valve (not shown).

Figure 7:
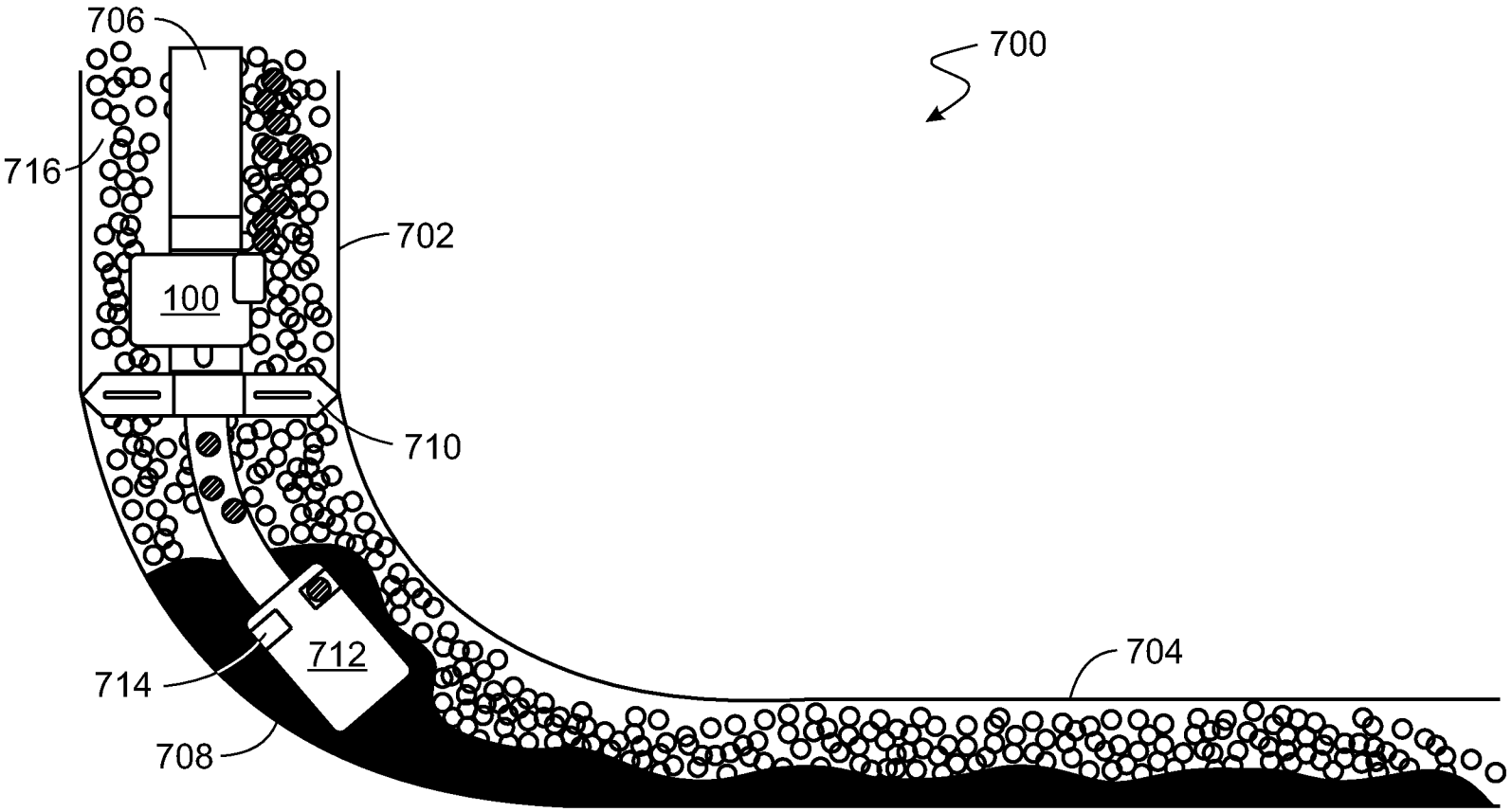
FIG. 7 is a schematic diagram showing a deployment of a downhole gas ventilation system in a wellbore with a deviated portion.

FIG. 7 is a schematic diagram showing a deployment of a downhole gas ventilation system in a wellbore 700 with a deviated portion. The DGVS schematically shown in FIG. 7 can be any of the DGVS' described in this disclosure with reference to FIGS. 1-4 and can include any of the perforated tubings described in this disclosure with reference to FIGS. 1-6. The wellbore 700 includes a vertical portion 702 that extends from a surface (not shown) through a subterranean zone. The wellbore 700 includes a deviated portion 704 (e.g., a horizontal portion or any length of a wellbore that is offset from the vertical). The operations of the DGVS are described with reference to a wellbore 700 that includes vertical and deviated portions, but can be implemented in a wellbore with only a vertical portion or in multi-lateral wells with only vertical or vertical and horizontal portions.

The multiphase hydrocarbons, which includes liquid phase (schematically shown in solid black in FIG. 7) and gaseous phase (schematically shown as black circles in FIG. 7), flow from the subsurface reservoir (not shown) through the deviated portion 704, through the vertical portion 702 and towards the surface. A production tubing 706 (for example, one substantially similar to the production tubing 102) can be installed within the wellbore 700. The production tubing 706 extends from the surface (not shown) of the wellbore 700 through the vertical portion 702 and into a bend 708 at which the downhole end of the vertical portion 702 connects with an entrance to the deviated portion 704. The production tubing 706 can be made up of multiple lengths of tubing that are of same or different diameters. A tubing anchor catcher (TAC) 710 can be used to support certain lengths of tubing installed downhole in the wellbore 700.

In some implementations, a downhole end of the production tubing 706, which is positioned at a downhole location (e.g., in the vertical portion 702, in the horizontal portion 704 or in the bend 708) can serve as an intake into which the multiphase hydrocarbons flows to enter the production tubing 706. That is, the production tubing 706 can receive the multiphase hydrocarbons directly and without any intermediate well component.

In some implementations, a gas separator 712 can be fluidically coupled to the downhole end of the production tubing 706. The gas separator 712 includes an intake 714 to receive the multiphase hydrocarbons. The gas separator 712 can facilitate separation of the liquid phase and the gaseous phase, for example, by gravimetric separation. For example, the flow direction of the multiphase hydrocarbons can be reversed (e.g., from uphole direction to downhole direction) within the gas separator 712 causing the gaseous phase to rise in the uphole direction and the liquid phase to fall in the downhole direction, resulting in a separation of the two phases.

The gas separator 712 can be installed at a downhole location within the wellbore 702. For example, the gas separator 712 can be installed in the vertical portion 702. In some implementations, the gas separator 712 can be installed in the bend 708. As the multiphase hydrocarbons flow into the bend 708, at least a portion of the liquid and gaseous phases are gravimetrically separated resulting in multiphase hydrocarbons with reduced gaseous phase (i.e., higher liquid fraction) to enter the intake 714 of the gas separator 712. Gaseous phase continues to rise towards the surface through an annulus 716 defined by the production tubing 706 and the wellbore 700.

The DGVS 100 (or any of the other DGVS' described in this disclosure with any of the perforated tubings described in this disclosure) can be installed in the vertical portion 702 downstream of (i.e., uphole of) the gas separator 712. In implementations without a gas separator 712, the DGVS 100 can be installed downstream of the intake into the production tubing 706. In any implementation, multiphase hydrocarbons flow towards the DGVS 100, which separates at least a portion of the gaseous phase from the liquid phase, and releases the separated gaseous phase into the annulus 716 through the check valve included in the DGVS 100.

The phase separation within the DGVS 100 and release of the gaseous phase through the check valve is aided by several flow conditions. For example, a specific gravity of the multiphase hydrocarbons in the production tubing 706 is different from the specific gravity of the fluids (e.g., the gaseous phase) in the annulus 716. The difference in specific gravities creates a pressure differential within the DGVS 100. In another example, in implementations that include the gas separator 712, the removal of a portion of the gaseous phase from the multiphase hydrocarbons by the gas separator 712 creates a pressure differential within the DGVS 100. In a further example, in implementations in which the DGVS 100 has a greater diameter than the production tubing 706 such that the DGVS 100 extends radially into the annulus 716, the distance between the outer surface of the DGVS 100 and the inner wall of the wellbore 700 is less than the distance between the outer surface of the production tubing 706 and the inner wall of the wellbore 700. The reduced distance creates a venturi effect as the free gas that rises through the annulus 716 flows past the DGVS 100. Each of the pressure differentials or the venturi effect or any combination of them aid in the gas separation within the DGVS 100 and release of the separated gas by the check valve into the annulus 716.

Figure 8:
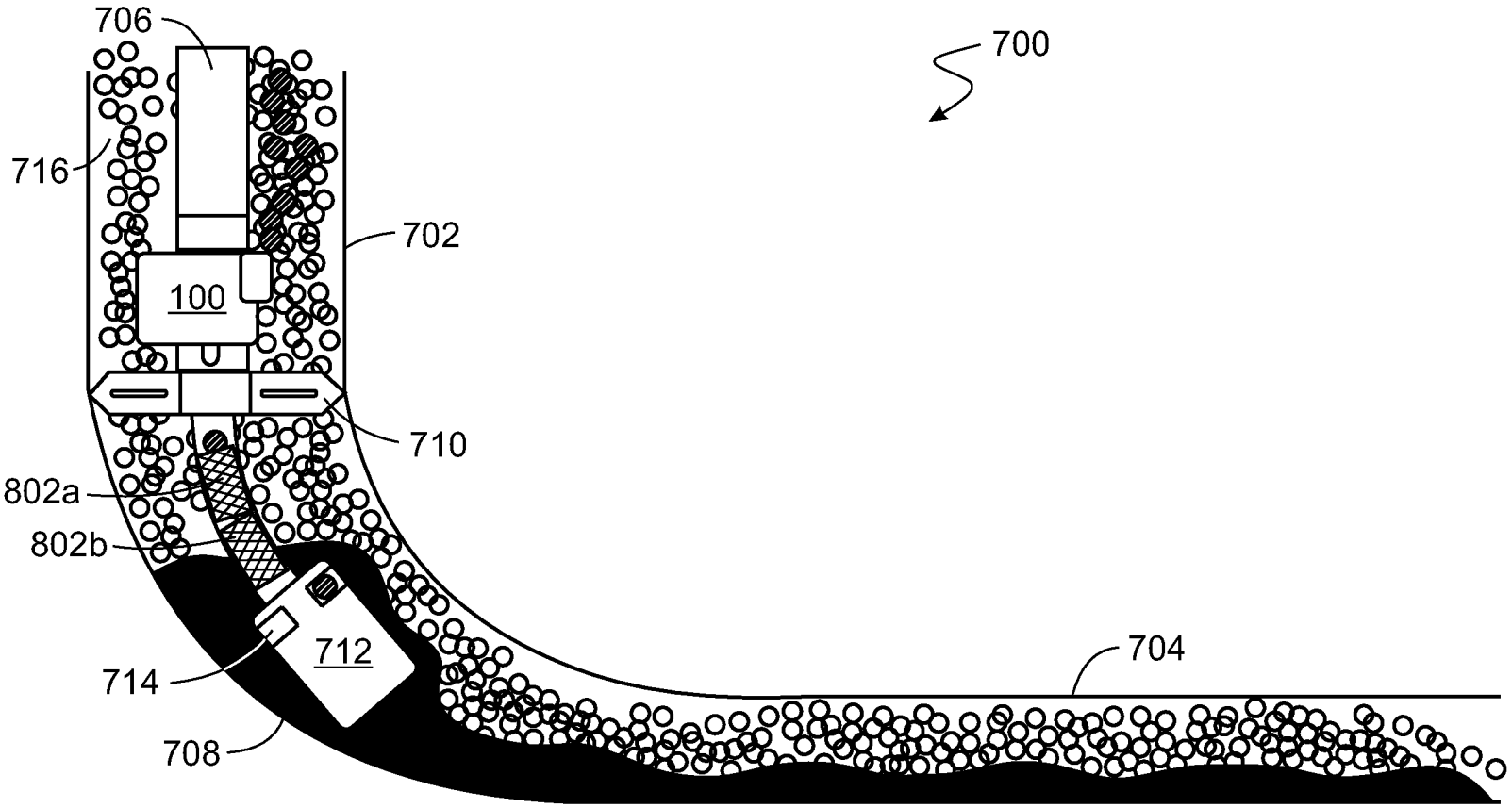
FIG. 8 is a schematic diagram showing a deployment of stages of downhole gas ventilation systems in a wellbore with a deviated portion.

FIG. 8 is a schematic diagram showing a deployment of stages (for example, a first stage 100, a second stage 802*a*, a third stage 802*b*) of downhole gas ventilation systems in a wellbore with a deviated portion. The wellbore schematically shown in and described with reference to FIG. 8 can be identical to that shown in and described with reference to FIG. 7. In addition to the DGVS 100 shown in and described with reference to FIG. 7, multiple DGVS' can be implemented as multiple stages in the wellbore 700. For example, a DGVS can be implemented as a first stage 802*a* downhole of (i.e., upstream of) of the DGVS 100. Another DGVS can be implemented as a second stage 802*b* downhole of the first stage 802*a*. Additional DGVS' can be implemented at different locations uphole or downhole of the DGVS 100. The multiphase hydrocarbons can flow through each stage in which the gaseous phase can be separated and released into the annulus 716. By deploying multiple DGVS in multiple stages, more gaseous phase can be removed from the multiphase hydrocarbons produced through the wellbore 700.

Figure 9:
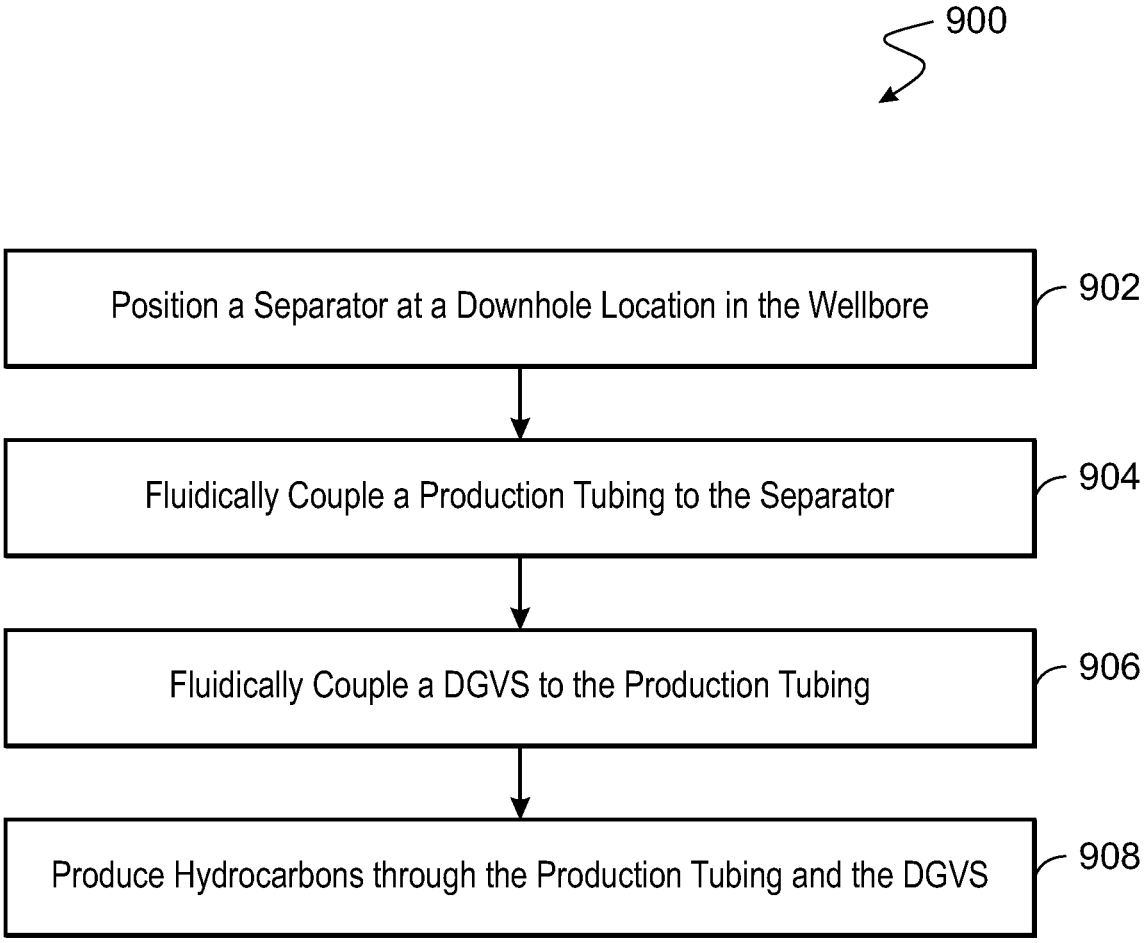
FIG. 9 is a flowchart of an example of a process of separating gaseous phase from multiphase hydrocarbons using a DGVS.

FIG. 9 is a flowchart of an example of a process 900 of separating gaseous phase from multiphase hydrocarbons using a DGVS. For example, the process 900 can be implemented by an operator of the equipment described in this disclosure and/or an operator of any of the DGVS' described in this disclosure. The process 900 can be implemented in a wellbore formed in a subterranean zone to a subsurface reservoir in which multiphase hydrocarbons that include a liquid phase and a gaseous phase are entrapped. The multiphase hydrocarbons flow from the subsurface reservoir through the wellbore. For example, the wellbore can be the wellbore 108 (FIG. 1) or the wellbore 700 (FIGS. 7, 8). At 902, a separator is positioned at a downhole location in the wellbore. For example, the well operator can lower the gas separator to any downhole location within the wellbore, e.g., within a vertical portion or within a deviated portion or at a bend that connects the vertical portion and the deviated portion. The gas separator separates a portion of the gaseous phase from the liquid phase. In some implementations (e.g., implementations in which the gas separator is positioned in the bend), a portion of the gaseous phase can be separated from the liquid phase before the multiphase hydrocarbons flow into the gas separator.

At 904, a production tubing is fluidically coupled to the separator. For example, the operator can couple the production tubing to the separator and lower both into the wellbore. The production tubing is configured to flow the multiphase hydrocarbons to the surface. In some implementations, the gas separator need not be used, and the production tubing alone can be lowered into the wellbore. In such implementations, a downhole end of the production tubing serves as the intake for the multiphase hydrocarbons.

At 906, a gas ventilation system (e.g., a DGVS) is fluidically coupled to the production tubing. For example, the DGVS can be coupled to the production tubing at the surface of the wellbore, and the production tubing and the DGVS can be lowered into the wellbore. As described earlier, the DGVS receives the multiphase hydrocarbons, separates the gaseous phase from the multiphase and flows the gaseous phase into an annulus defined between the production tubing and an inner wall of the wellbore. The fluid that is flowed into the annulus after the separation can include liquid phase, but the liquid fraction in such multiphase fluid is smaller than the liquid fraction upstream of the DGVS. At 908, hydrocarbons are produced through the production tubing and the DGVS.

Figure 10:
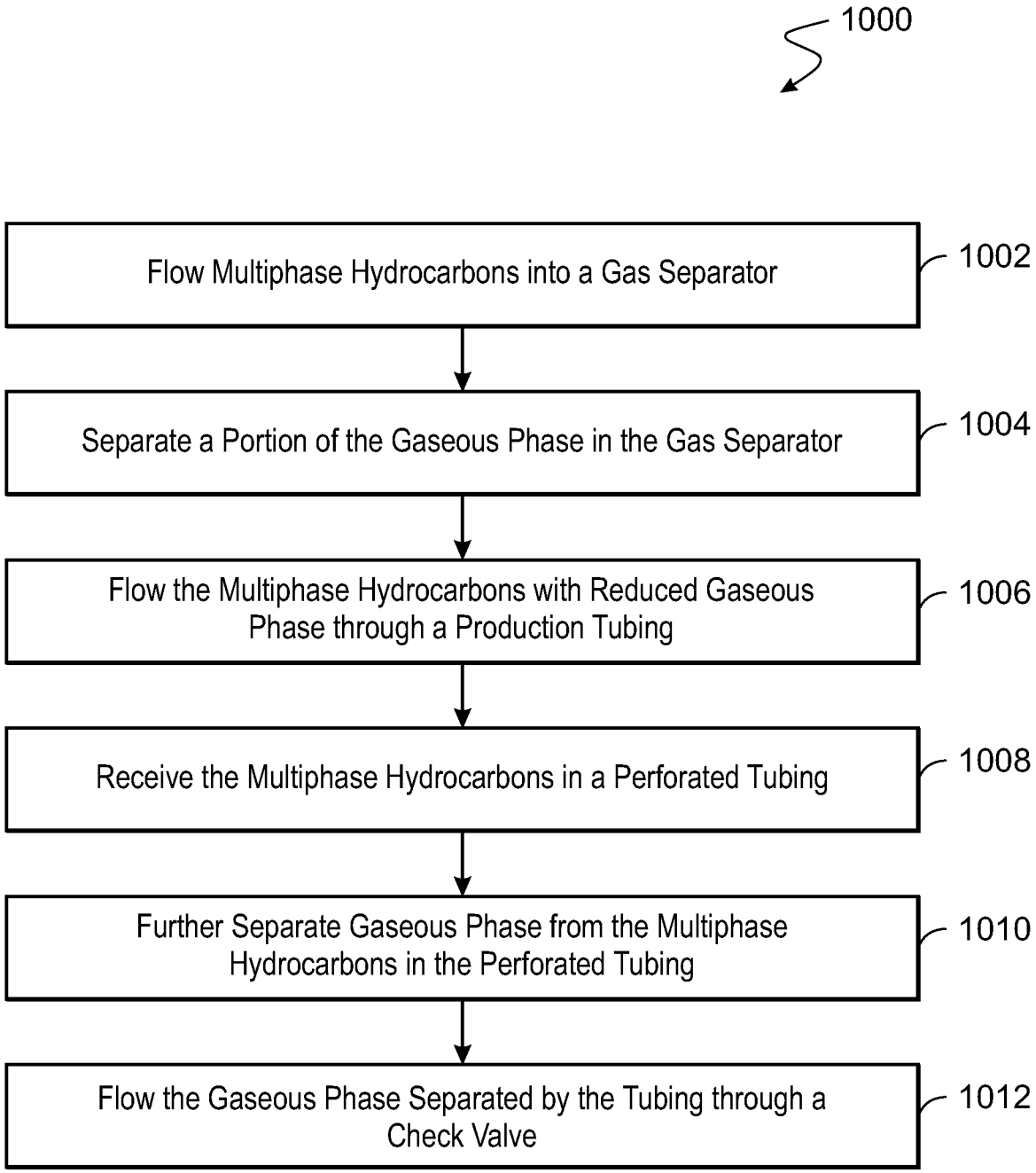
FIG. 10 is a flowchart of an example of a process of operating the DGVS.

FIG. 10 is a flowchart of an example of a process 1000 of operating the DGVS. For example, the process 100 can be implemented by the wellbore equipment disclosed in this disclosure including the DGVS. The process 1000 can be implemented in a wellbore formed in a subterranean zone to a subsurface reservoir in which multiphase hydrocarbons that include a liquid phase and a gaseous phase are entrapped. The multiphase hydrocarbons flow from the subsurface reservoir through the wellbore. For example, the wellbore can be the wellbore 108 (FIG. 1) or the wellbore 700 (FIGS. 7, 8). At 1002, multiphase hydrocarbons are flowed into a gas separator positioned at a downhole location in the wellbore. In some implementations, the gas separator is fluidically coupled to the production tubing. In some implementations, a gas separator is not used and the multiphase hydrocarbons flow directly into a downhole end of a production tubing. In implementations involving a wellbore with a vertical portion and a deviated portion, the downhole end of the production tubing or the gas separator is positioned at the bend so that a portion of the gaseous phase is removed from the multiphase hydrocarbons before the multiphase hydrocarbons flow into the intake, either of the production tubing or the gas separator.

At 1004, the gas separator separates a portion of the gaseous phase from the liquid phase. In implementations in which the gas separator is positioned in the bend connecting the vertical portion and the horizontal portion, the gas separator separates a portion of the gaseous phase from the liquid phase that already has a reduced gaseous phase.

At 1006, a production tubing fluidically coupled to the gas separator and extending to the surface flows the multiphase hydrocarbons with the reduced gaseous phase. The production tubing defines an annulus with an inner wall of the wellbore.

At 1008, a perforated tubing of the DGVS, which is installed downstream of the gas separator and is fluidically coupled to the production tubing, receives the portion of the multiphase hydrocarbons with the reduced gaseous phase. At 1010, the perforated tubing further separates gaseous phase from the multiphase hydrocarbons received by the perforated tubing. At 1012, the check valve in the DGVS flows the separated gaseous phase into the annulus. The liquid phase flows through the production tubing towards the surface, e.g., towards a pump installed downstream of the DGVS. The multiphase fluid that flows through the perforated tubing of the DGVS into the annulus has a higher gaseous fraction compared to the multiphase fluid upstream of the DGVS. Conversely, the liquid phase that flows through the production tubing downstream of the DGVS has a higher liquid fraction compared to the multiphase fluid upstream of the DGVS.

Thus, particular implementations of the subject matter have been described. Other implementations are within the scope of the following claims.

The invention claimed is:

1. A downhole gas ventilation system comprising:

a perforated tubing configured to be positioned within a production tubing installed in a wellbore formed in a subterranean zone to a subsurface reservoir in which multiphase hydrocarbons comprising a liquid phase and a gaseous phase are entrapped, the perforated tubing configured to fluidically couple to wellbore equipment configured to be positioned uphole of the perforated tubing within the wellbore and to permit flow of the multiphase hydrocarbons received within the perforated tubing into the wellbore equipment, the perforated tubing comprising an upper end, a lower end and a sidewall connecting the upper end and the lower end, a plurality of perforations formed in the sidewall and configured to receive the multiphase hydrocarbons within the perforated tubing, an outer diameter of the perforated tubing being smaller than an inner diameter of the production tubing, the perforated tubing configured to facilitate separation of the liquid phase from the gaseous phase of the received multiphase hydrocarbons;

a one-way check valve fluidically coupled to the production tubing, the check valve configured to vent the gaseous phase that rises past the perforated tubing, out of the production tubing, and into an annulus defined between the production tubing and an inner wall of the wellbore; and a mandrel, the one-way check valve installed within the mandrel, the mandrel configured to receive the gaseous phase that rises past the perforated tubing, wherein at least a portion of the perforated tubing including the upper end passes through the mandrel.

2. The system of claim 1, further comprising a seating nipple configured to connect to the perforated tubing, wherein the seating nipple, on one end, is configured to attach to the upper end of the perforated tubing, and on the opposite end, is configured to attach to the wellbore equipment, wherein the seating nipple is configured to flow the liquid phase that is separated from gaseous phase within the perforated tubing into the wellbore equipment.

3. The system of claim 1, wherein the upper end of the perforated tubing is directly connected to the wellbore equipment.

4. The system of claim 1, wherein an outer diameter of the mandrel is greater than an outer diameter of the production tubing and smaller than an inner diameter of the wellbore.

5. The system of claim 1, wherein the one-way check valve is installed in a portion of the mandrel that extends into the annulus.

6. The system of claim 1, wherein the perforated tubing is substantially concentric with respect to the production tubing.

7. The system of claim 1, wherein the perforated tubing is installed adjacent an inner surface of the production tubing.

8. The system of claim 1, wherein the perforated tubing is an elongate, cylindrical tubing.

9. The system of claim 8, wherein the perforated tubing comprises a plurality of helical grooves formed on an outer surface of the elongate, cylindrical tubing.

10. The system of claim 1, wherein the perforated tubing comprises alternating portions of larger and smaller volumes arranged along an axis of the perforated tubing.

11. The system of claim 1, wherein the perforated tubing is a gas anchor or a dip tube.

12. A method comprising:

in a wellbore formed in a subterranean zone to a subsurface reservoir in which multiphase hydrocarbons comprising a liquid phase and a gaseous phase are entrapped, the multiphase hydrocarbons flowing from the subsurface reservoir through the wellbore:

positioning a separator at a downhole location in the wellbore, wherein a portion of the gaseous phase is separated from the liquid phase before flowing into the separator through an intake of the separator resulting in multiphase hydrocarbons with the liquid phase and reduced gaseous phase;

fluidically coupling a production tubing to the separator, the production tubing extending to the surface and configured to flow the multiphase hydrocarbons with the liquid phase and the reduced gaseous phase received via the intake of the separator to the surface;

fluidically coupling a gas ventilation system to the production tubing, wherein the gas ventilation system:

receives the multiphase hydrocarbons with the liquid phase and the reduced gaseous phase flowed through the production tubing, further separates, by a perforated tubing of the gas ventilation system, gaseous phase from the liquid phase, flows, by a one-way check valve of the gas ventilation system installed within a mandrel of the gas ventilation system, separated gaseous phase into an annulus defined between the production tubing and an inner wall of the wellbore, and flows, by the perforated tubing, the separated liquid phase toward a surface of the wellbore, wherein at least a portion of the perforated tubing including an upper end of the perforated tubing passes through the mandrel.

13. The method of claim 12, wherein the wellbore comprises a substantially vertical portion and a deviated portion extending from a downhole end of the substantially vertical portion through the subterranean zone, the wellbore comprising a bend connecting the substantially vertical portion to the deviated portion, wherein positioning the separator at the downhole location comprises positioning the separator in the bend.

14. A method comprising:

in a wellbore formed in a subterranean zone to a subsurface reservoir in which multiphase hydrocarbons comprising a liquid phase and a gaseous phase are entrapped, the multiphase hydrocarbons flowing from the subsurface reservoir through the wellbore:

flowing, into a gas separator positioned at a downhole location in the wellbore, the multiphase hydrocarbons;

separating, by the gas separator, a portion of the gaseous phase from the liquid phase resulting in multiphase hydrocarbons with reduced gaseous phase and the liquid phase;

flowing, through a production tubing fluidically coupled to the gas separator and extending to the surface, the multiphase hydrocarbons with the reduced gaseous phase and the liquid phase, the production tubing defining an annulus with an inner wall of the wellbore;

receiving, in a perforated tubing installed downstream of the gas separator and fluidically coupled to the production tubing, the multiphase hydrocarbons with the reduced gaseous phase and the liquid phase, wherein an upper end of the perforated tubing passes through a mandrel;

further separating, by the perforated tubing, gaseous phase from the liquid phase;

receiving, by a one-way check valve installed in the mandrel, the gaseous phase further separated by the perforated tubing and flowed through the production tubing past the perforated tubing;

flowing, by the one-way check valve, the gaseous phase further separated by the perforated tubing into an annulus defined between the production tubing and an inner wall of the wellbore; and flowing, by the perforated tubing, the liquid phase toward a surface of the wellbore.

15. The method of claim 14, wherein the wellbore comprises a substantially vertical portion and a deviated portion extending from a downhole end of the substantially vertical portion through the subterranean zone, the wellbore comprising a bend connecting the substantially vertical portion to the deviated portion, wherein positioning the separator at the downhole location comprises positioning the separator in the bend.

* * * * *